United States Patent [19]

Barber

[11] Patent Number: 4,517,062

[45] Date of Patent: May 14, 1985

[54] PROCESS FOR THE ELECTROCHEMICAL SYNTHESIS OF ETHYLENE GLYCOL FROM FORMALDEHYDE

[75] Inventor: James J. Barber, Montvale, N.J.

[73] Assignee: The Halcon SD Group, Inc., New York, N.Y.

[21] Appl. No.: 548,461

[22] Filed: Nov. 3, 1983

[51] Int. Cl.[3] ..... C25B 3/10

[52] U.S. Cl. ..... 204/77; 204/59 R

[58] Field of Search ..... 204/72, 59 R, 77

[56] References Cited

U.S. PATENT DOCUMENTS 4,270,992 6/1981 Saito ..... 204/72

OTHER PUBLICATIONS

*Organic Electrochemistry*, 2nd Ed., New York, 1983, pp. 328–329.

*Primary Examiner*—John F. Niebling

*Attorney, Agent, or Firm*—William C. Long; Riggs T. Stewart; Daniel R. Zirker

[57] ABSTRACT

A process for the formation of glycols, particularly ethylene glycol through the electrochemical coupling of aldehydes such as formaldehyde in neutral or acidic solutions producing high yields and product selectivities is disclosed. The process can also be effectively operated in the presence of a wide variety of polar, miscible, organic cosolvents.

15 Claims, No Drawings

PROCESS FOR THE ELECTROCHEMICAL SYNTHESIS OF ETHYLENE GLYCOL FROM FORMALDEHYDE

BACKGROUND OF THE INVENTION

1. Field of the Invention

This invention relates to a process for the production of a glycol from an aldehyde feedstock, and more particularly, relates to an efficient electrochemical coupling of formaldehyde in neutral or acidic aqueous or aqueous-organic solutions at carbon-based electrodes to form ethylene glycol.

2. Description of the Prior Art

The formation of glycols through the mechanism of an electrochemical coupling of selected aldehydes and ketones is a generic reaction well documented in the prior art. The electrochemical reduction of formaldehyde, however, generally yields methanol, the product of a two-electron reduction, rather than ethylene glycol, the coupled product of a one-electron reduction. Only two references are believed to document the electrochemical coupling of formaldehyde to glycol, and the methods described in each of these reports are flawed in important respects. In J.Gen.Chem. USSR, 1973, 43, 2769, Tomilov and co-workers disclosed an attempt to couple formaldehyde to glycol at graphite electrodes in acidic solutions of $KH_2PO_4$ in the presence of Hg(II) ions. However, the current efficiency reported in this system was only 25%, which is unacceptably low for commercial application. In addition, the presence of mercury in the reaction is particularly undesirable for public health and environmental concerns. More recently, in U.S. Pat. No. 4,270,992, Saito has reported that ethylene glycol can be formed at current efficiencies as high as 80% when formaldehyde is electrolyzed at a carbon type cathode in very alkaline solutions. The highest current efficiencies were reported in formalin solutions of NaOH and KOH, at a reaction temperature of 50° C. This system, however, possesses at least two serious drawbacks. First, formaldehyde undergoes the well known base-catalyzed Cannizzaro reaction under the conditions present in Saito's electrolysis, in which two moles of formaldehyde yield one mole each of methanol and methyl formate, thus resulting in nonproductive consumption of formaldehyde. Second, ethylene glycol must be separated from an aqueous base solution. Separation of the desired product from the electrolyte is a complicating factor in any electrochemical synthesis, and this problem is aggravated where the product is less volatile than either the reactants or solvent, particularly since it is desirable to recycle the electrolyte and any unreacted starting materials in a simple and inexpensive manner. In Saito's system, the product glycol is less volatile than either the formaldehyde reactant or the water solvent, and such common separation techniques as distillation would entail a separation of glycol from solid NaOH or KOH.

It an object of this invention to provide an efficient electrolytic method for converting aldehydes, such as formaldehyde, to glycols, such as ethylene glycol, that does not have the selectivity affected by harmful competing side reactions and that is capable of producing product in high yield and selectivity.

It is another object of this invention to provide a process for producing ethylene glycol from formaldehyde in a simple manner with high current efficiencies and high product yields and selectivities in neutral or acidic aqueous or aqueous-organic cosolvent solutions.

It is still another object of this invention to provide a process wherein the glycol product can be easily and effectively separated from a reaction mixture containing a high boiling organic cosolvent.

SUMMARY

In accordance with the aforementioned objects, a novel process has been discovered for the formation of glycols, particularly ethylene glycol, through the electrochemical coupling of aldehydes, particularly formaldehyde, in neutral or acidic solutions, e.g. solutions having a pH between about 2 and 7, comprising forming an aqueous solution of the aldehyde of effective strength, adding an effective amount of a neutral or acidic electrolyte, preferably NaCl or $(CH_3)_4NCl$, to the solution either with or without the presence of a polar, miscible organic cosolvent; forming the predetermined glycol product by passing an effective amount of electrical current between a cathode, formed from a carbon-based material, and an effective non-corrodible anode, immersed in the electrolytic solution, and separating the resultant formed glycol, e.g., ethylene glycol, from the reaction mixture by conventional separation techniques, e.g., distillation.

DETAILED DESCRIPTION OF THE INVENTION

It has surprisingly been discovered that glycols, and particularly ethylene glycol, can be efficiently formed through the electrochemical coupling of aldehydes, particularly formaldehyde, in both neutral and acidic aqueous solutions, as well as in neutral and acidic aqueous solutions containing organic cosolvents, at carbon-based cathodes.

In accordance with the electrochemical process, it is sufficient to position a cathode and anode of suitable composition in the electrolytic solution without being required to partition the cathode and anode with a diaphragm or other effective separation means, although this can also be done.

It is essential that the cathode be comprised of a carbon-based material, such as carbon or graphite. A suitable anode material, in the broadest embodiment, can encompass almost any non-corrodible substance, and is preferably either carbon or graphite. Certain metal oxide anodes such as $PbO_2$, $Fe_3O_4$, dimensionally stable anodes, e.g., DSAs, as well as others known to those skilled in the art, can also be employed, as can anodes constructed of gold, the platinum metals, and the like.

Although the precise current density used in the process is not critical, higher yields of coupled glycol product are generally favored by higher current densities. Thus, current densities can range, for example, from 0.1 to 5.0 $A/cm^2$, and most preferably from 0.5 to 3.0 $A/cm^2$. It is particularly desirable for industrial processes that high current densities be used.

A large number of neutral or acidic electrolytes have been found to be effective, and, in the broadest embodiment, can include a wide variety of salts containing any of the univalent cations together with a wide variety of anionic species including the halides, sulfates, tetrafluoroborates, perchlorates, and the like; preferably the alkali metal or tetraalkylammonium halides and most preferably salts having the composition MX, wherein M represents sodium, potassium, rubidium, cesium, tetraalkylammonium and the like and X represents chloride, bromide, or iodide, as well as mixtures thereof. Best results have been achieved with NaCl and $Me_4NCl$ electrolytes.

Surprisingly it has been found that addition of a wide variety of polar, miscible organic cosolvents such as sulfolane, N-methylpyrrolidinone, THF, and acetonitrile, causes an improvement in the current efficiencies for glycol formation. When the organic cosolvent is also high-boiling, e.g., sulfolane or adiponitrile, not only are improved current efficiencies obtained, but also the separation of glycol product from the electrolyte is made practicable by enabling the distillation of glycol from the electrolyteorganic cosolvent mixture.

The temperature of the reaction mixture is an important variable and is suitably maintained from about 50° to about 100° C., and most preferably from about 60° to 90° C.

The pH can be anywhere in the neutral to acidic range, and preferably ranges from about 2 to 7. The pH need not be regulated externally, and if it is not will assume a value ranging from about 3 to 6 during electrolysis. It is, of course, essential to operate at lower pH's so as to avoid those harmful competing reactions that occur in strong basic media, cited above, for example, below pH's of about 8.

Circulation of the electrolyte and solvent in the reaction vessel is advantageous and may be achieved by stirring, pumping, or any other means known to those skilled in the art.

Concentrations of formaldehyde, cosolvent, and electrolyte can be varied over fairly broad ranges, the precise preferred concentrations depending on the particular cosolvent and electrolyte used. In general, formaldehyde preferably comprises between 10 and 40 wt. % and the organic cosolvent is preferably between 5 and 50 wt. %. Electrolyte concentration is not critical, and preferably comprises between 0.1 and 5.0N. The remainder of the solution is water or, where commercial formalin is used as the formaldehyde source, water and methanol.

The process of the invention may be carried out either in a batch reactor or in a continuous system. It is advantageous to continue the electrochemical coupling until final concentrations (or stationary concentrations, in continuous systems) of the glycol product range from about 1 to 20 wt. %, and preferably range from about 4 to 10 wt. %.

Current efficiencies based on formaldehyde of over 90% have been achieved using the aforementioned process.

The following examples are provided to illustrate the invention but are not construed as limiting the invention in any way except as indicated by the appended claims.

EXAMPLE 1

Sodium chloride (3.5 g) and commercial 37% formalin solution (60 mL) supplied from Aldrich Chemical Co., Milwaukee, Wis. were stirred in a 100 mL 3-neck flask equipped with a reflux condenser. Two graphite rod electrodes of 0.25 inch diameter, such as can be obtained from Alpha Products, Morton Thiokol Inc., or from Saturn Industries, Inc. were immersed approximately 1 cm into the solution positioned with an interelectrode spacing of approximately 1.0 cm. Electrolysis was carried out at a constant current of 1.0 A at a reaction temperature of 70° C. After 3 hours, 2.73 g of ethylene glycol had formed, as determined by gas chromatography. This yield corresponds to a current efficiency of 78%.

EXAMPLES 2–8

In each of these examples, the same procedure as in Example 1 was used, except for the substitution of different electrolytes.

Table 1 summarizes the results.

TABLE 1

| Example | Electrolyte (g) | Current Efficiency |
|---|---|---|
| 2 | $Me_4NCl$ (6.6) | 75% |
| 3 | NaBr (10.6) | 67% |
| 4 | NaI (15.4) | 63% |
| 5 | $Na_2SO_4$ (8.5) | 63% |
| 6 | $NaBF_4$ (6.6) | 68% |
| 7 | KCl (10.7) | 38% |
| 8 | CsI (10.0) | 56% |

EXAMPLE 9

This example illustrates the use of the organic cosolvent sulfolane with NaCl electrolyte. The same apparatus was used as described in Example 1. Sodium chloride (3.5 g), a commercial 37% formalin solution (50 mL), and sulfolane (10 mL) were mixed and electrolyzed at a constant current of 1.0 A and a reaction temperature of 70° C. After 3.0 hours, 3.03 g ethylene glycol had formed, corresponding to a current efficiency of 87%.

EXAMPLE 10

This example illustrates the use of the organic cosolvent methanol with $Me_4NCl$ electrolyte. The same apparatus was used as described in Example 1. Tetramethylammonium chloride (6.6 g), a commercial 37% formalin solution (40 mL), and methanol (20 mL) were mixed and electrolyzed at a constant current of 1.0 A and a reaction temperature of about 70° C. After 3.0 hours, 2.89 g of ethylene glycol had formed, corresponding to a current efficiency of 83%.

EXAMPLES 11–13

In each of these examples, the same procedure as in Example 9 was used except for the substitution of different organic cosolvents. Table 2 summarizes the results.

TABLE 2

| Example | Cosolvent | Current Efficiency |
|---|---|---|
| 11 | THF | 93% |
| 12 | Acetonitrile | 90% |
| 13 | N—Methylpyrrolidinone | 89% |

I claim:

1. A process for the formation of glycols through the electrochemical coupling of formaldehyde in neutral or acidic solutions comprising:

forming an aqueous solution of formaldehyde of effective strength;

adding an effective amount of a suitable electrolyte selected from the group of salts having a composition MX, wherein M represents any univalent cation and X represents an anionic species including the halides, sulfates, tetrafluoroborates, and perchlorates, as well as mixtures thereof;

forming the predetermined glycol product by passing an effective amount of electrical current between a cathode, formed from a carbon-based material, and an anode, formed from a non-corrodible substance, immersed in the electrolytic solution;

separating the resultant formed glycol from the reaction mixture.

2. A process as claimed in claim 1 wherein the aqueous solution further comprises a polar, miscible, organic cosolvent.

3. A process as claimed in claim 1 wherein the formed glycol is ethylene glycol.

4. A process as claimed in claim 1 wherein the pH of the solution ranges from about 2 to 7.

5. A process as claimed in claim 1 wherein the electrolyte is selected from the group of salts having a composition MX, wherein M is sodium, potassium, rubidium, cesium, or tetraalkylammonium, and X is chloride, bromide or iodide, as well as mixtures thereof.

6. A process as claimed in claim 5 wherein the electrolyte is selected from the group of NaCl and $(CH_3)_4NCl$.

7. A process as claimed in claim 2 wherein the organic cosolvent possesses a higher boiling point than does the formed glycol product.

8. A process as claimed in claim 7 wherein the formed glycol product is ethylene glycol.

9. A process as claimed in claim 2 wherein the organic cosolvent is selected from the group of sulfolane and adiponitrile.

10. A process as claimed in claim 1 wherein the amount of electrical current passed through the solution can range from about 0.1 to 5.0 $A/cm^2$.

11. A process as claimed in claim 1 wherein the anode is selected from the group of carbon or graphite.

12. A process as claimed in claim 1 wherein the glycol is separated from the reaction mixture by distillation.

13. A process as claimed in claim 1 wherein the solution temperature ranges from about 50°–100° C.

14. A process as claimed in claim 1 wherein the process is carried out in a batch reactor.

15. A process as claimed in claim 1 wherein the process is carried out in a continuous system.

* * * * *